US009382835B2

(12) United States Patent
Bartsch et al.

(10) Patent No.: US 9,382,835 B2
(45) Date of Patent: Jul. 5, 2016

(54) INTERNAL COMBUSTION ENGINE HAVING A DIRECT INJECTION SYSTEM AND HAVING A PORT FUEL INJECTION SYSTEM

(71) Applicant: Ford Global Technologies, LLC, Dearborn, MI (US)

(72) Inventors: Guenter Bartsch, Gummersbach (DE); Oliver Berkemeier, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 376 days.

(21) Appl. No.: 13/909,929

(22) Filed: Jun. 4, 2013

(65) Prior Publication Data

US 2013/0333660 A1 Dec. 19, 2013

(30) Foreign Application Priority Data

Jun. 15, 2012 (DE) ..... 10 2012 210 072

(51) Int. Cl.

| | |
|---|---|
| ***F02B 17/00*** | (2006.01) |
| ***F02M 39/02*** | (2006.01) |
| ***F02M 59/44*** | (2006.01) |
| ***F02M 69/04*** | (2006.01) |

(52) U.S. Cl.

CPC ..... *F02B 17/005* (2013.01); *F02M 39/02* (2013.01); *F02M 59/447* (2013.01); *F02M 69/046* (2013.01); *F02M 2200/02* (2013.01)

(58) Field of Classification Search

CPC .... F02B 17/005; F02M 39/02; F02M 59/447; F02M 2200/02; F02M 69/046; B60W 10/06; F01L 13/0036; F01L 1/143; F01L 1/25; F01L 2001/0537; F01L 2013/001; F01L 2001/34453; F01L 2001/467; F01L 1/06; F01L 2105/00; F01L 9/023; F02D 41/0087; F02D 2041/0012; F02D 2200/602; Y02T 10/44; F02N 2200/101; F02N 2200/102; F02N 2200/103

USPC ..... 123/431, 446, 456, 300, 406.47, 445

See application file for complete search history.

(56) References Cited

U.S. PATENT DOCUMENTS

| | | | | |
|---|---|---|---|---|
| 5,617,831 | A * | 4/1997 | Shirakawa | F02D 41/062 123/179.17 |
| 2001/0011537 | A1* | 8/2001 | Joos et al. | 123/497 |
| 2004/0206337 | A1* | 10/2004 | Tokuyasu et al. | 123/497 |
| 2005/0098155 | A1* | 5/2005 | Yamazaki et al. | 123/431 |
| 2005/0183698 | A1* | 8/2005 | Yonezawa | F02D 35/0046 123/431 |
| 2007/0073467 | A1* | 3/2007 | Hill | F02D 35/02 701/105 |
| 2007/0101977 | A1* | 5/2007 | Stewart | F02D 41/0007 123/679 |
| 2007/0119422 | A1* | 5/2007 | Lewis et al. | 123/431 |
| 2008/0314364 | A1* | 12/2008 | Okamoto | 123/458 |

(Continued)

FOREIGN PATENT DOCUMENTS

WO 2012055610 A1 5/2012

*Primary Examiner* — Hung Q Nguyen
*Assistant Examiner* — Brian P Monahon
(74) *Attorney, Agent, or Firm* — James Dottavio; Alleman Hall McCoy Russell & Tuttle LLP

(57) ABSTRACT

A system and methods are provided to deactivate a cam driven fuel pump. The system comprises a direct fuel injection system; a port fuel injection system; a pump for the direct injection system driven by a cam, wherein the pump can be activated and deactivated as a function of the activation of the direct injection system. Deactivating a pump when no fuel is pumped through it minimizes wear on pump components and increases efficiency.

15 Claims, 6 Drawing Sheets

(56) References Cited

U.S. PATENT DOCUMENTS

| | | | | |
|---|---|---|---|---|
| 2009/0038587 | A1 | 2/2009 | Pursifull et al. | |
| 2009/0223468 | A1* | 9/2009 | Smith | F01L 1/46 123/90.13 |
| 2009/0272365 | A1* | 11/2009 | Kunz | F02B 9/042 123/508 |
| 2010/0024771 | A1* | 2/2010 | Bidner et al. | 123/446 |
| 2010/0100299 | A1* | 4/2010 | Tripathi | F02D 41/0087 701/102 |
| 2010/0162619 | A1 | 7/2010 | Peus | |
| 2010/0269791 | A1 | 10/2010 | Lucido et al. | |
| 2011/0162619 | A1 | 7/2011 | Ulrey et al. | |
| 2011/0265765 | A1* | 11/2011 | Furuhashi | F02D 41/3809 123/446 |

* cited by examiner

INTERNAL COMBUSTION ENGINE HAVING A DIRECT INJECTION SYSTEM AND HAVING A PORT FUEL INJECTION SYSTEM

CROSS REFERENCE TO RELATED APPLICATIONS

The present application claims priority to German Patent Application No. 102012210072.5, filed on Jun. 15, 2012, the entire contents of which are hereby incorporated by reference for all purposes.

TECHNICAL FIELD

The disclosure relates to an internal combustion engine having a direct injection system and having a port fuel injection system.

BACKGROUND AND SUMMARY

In engines with fuel injection, the injection of the fuel may take place either directly into the cylinders or into the intake tract, for example into the intake manifold or some other region of the intake tract situated upstream of the inlet valve of a cylinder. The first variant is realized in so-called direct injection systems, and the second variant is realized in so-called port fuel injection systems.

US 2010/0024771 A1 presents an injection system having a direct injection system and having a port fuel injection system and also having a valve for switching between the two injection systems. Two fuel pumps and two tanks are provided. The valve can switch different configurations of the components.

US 2010/0162619 A1 discloses an engine whose main water pump is activated and deactivated as a function of the temperature of the cooling liquid of the engine.

US 2010/0269791 A1 describes a direct injection system and a diagnostic system for a pressure sensor, in which, in a diagnostic mode, one of two fuel pumps connected in series is deactivated.

US 2009/0038587 A1 presents a method for controlling a direct injection system having a suction pump and having a pump for the fuel. A setting for cold starting ensures a fast pressure build-up, and a second setting with pump deactivation is provided for normal driving operation.

In engines equipped with both direct injection and port fuel injection, direct injection may be disabled but a pump may continue to operate. Dry operation of the piston may create excessive heat which may lead to leakage due to hot fuel deposit formation or wear on components.

The inventors herein recognize the above described disadvantages and disclose a systems and methods for an internal combustion engine having a direct injection system and having a port fuel injection system comprising: a pump for the direct injection system, wherein the pump can be activated and deactivated as a function of the activation of the direct injection system. The pump can thus be deactivated when the direct injection system is deactivated. In this way, overheating of a pump which is running dry may be prevented, which increases the service life and reliability of the pump and of the engine as a whole. In particular, it is possible to prevent a situation in which the pump or a piston is in motion even though no fuel is flowing through the pump.

The pump may, for activation and deactivation, be connected to a cam drive. It is possible in particular to use the technique which is used for the shutdown of cylinders. The pump may be mechanically connected to a drive system of the engine. Often, the drive of the pumps is derived from the drive system; this can also be realized with the present disclosure. Deactivation of the pump thus entails a mechanical decoupling of the pump from the drive system of the engine.

A system and methods are provided to deactivate a cam driven fuel pump. The system comprises a direct fuel injection system; a port fuel injection system; a pump for the direct injection system driven by a cam, wherein the pump can be activated and deactivated as a function of the activation of the direct injection system. Deactivating a pump when no fuel is pumped through it minimizes wear on pump components and increases efficiency.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Further, the inventors herein have recognized the disadvantages noted herein, and do not admit them as known.

DETAILED DESCRIPTION

Figure 1:
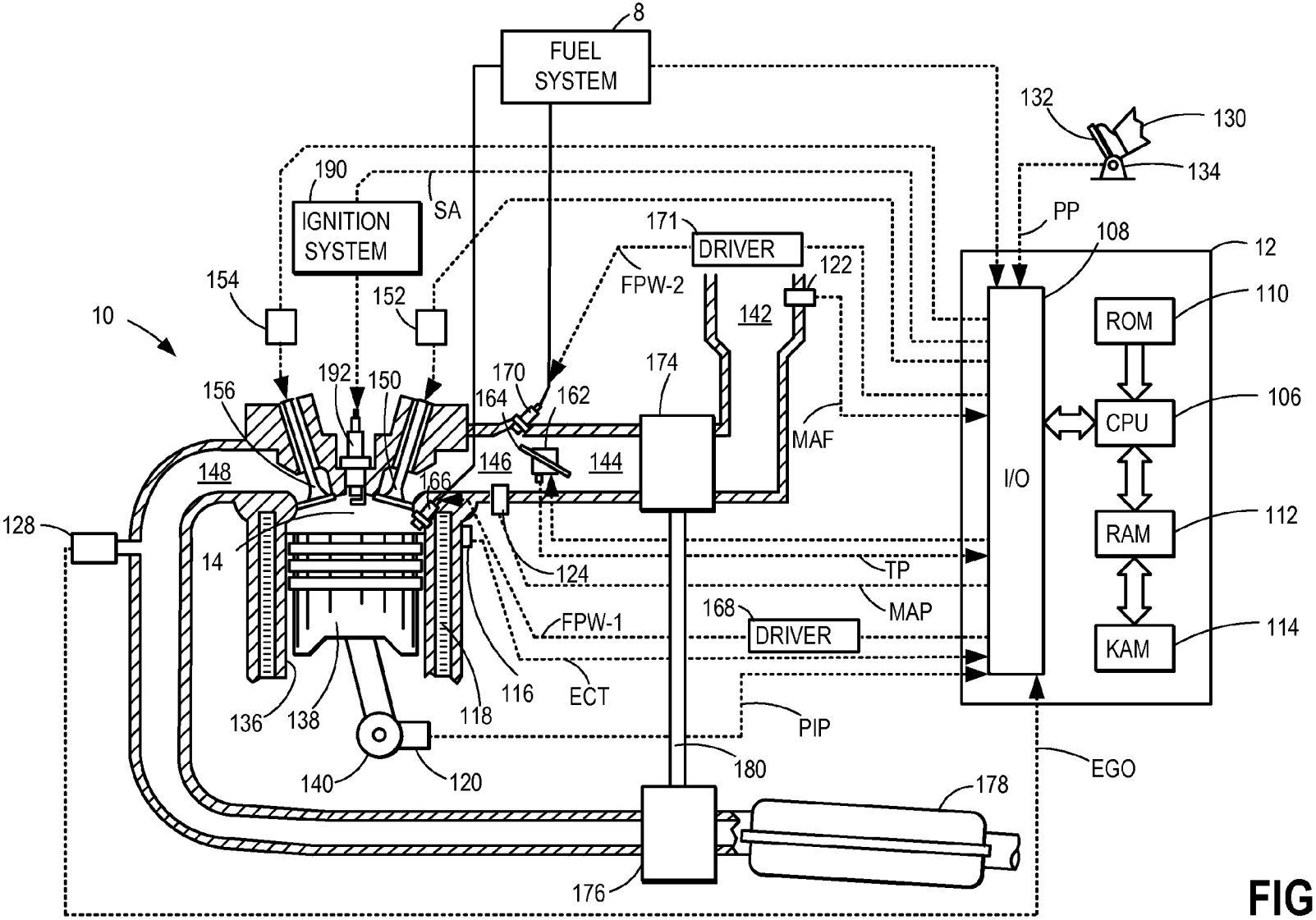
FIG. 1 schematically depicts an example embodiment of a cylinder of an internal combustion engine.

FIG. 1 depicts an example embodiment of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be disposed downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2-3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump, and a fuel rail. Alternatively, fuel may be delivered by a single stage fuel pump at lower pressure, in which case the timing of the direct fuel injection may be more limited during the compression stroke than if a high pressure fuel system is used. Further, the fuel tank may have a pressure transducer providing a signal to controller 12. An example embodiment of fuel system 8 is further elaborated herein with reference to FIG. 2.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein may not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows one cylinder of a multi-cylinder engine. As such each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

In some embodiments, fuel system 8 may comprise two fuel tanks which may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling. In another embodiment, direct injector 166 and port fuel injector 170 may share a common fuel tank.

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

Figure 2:
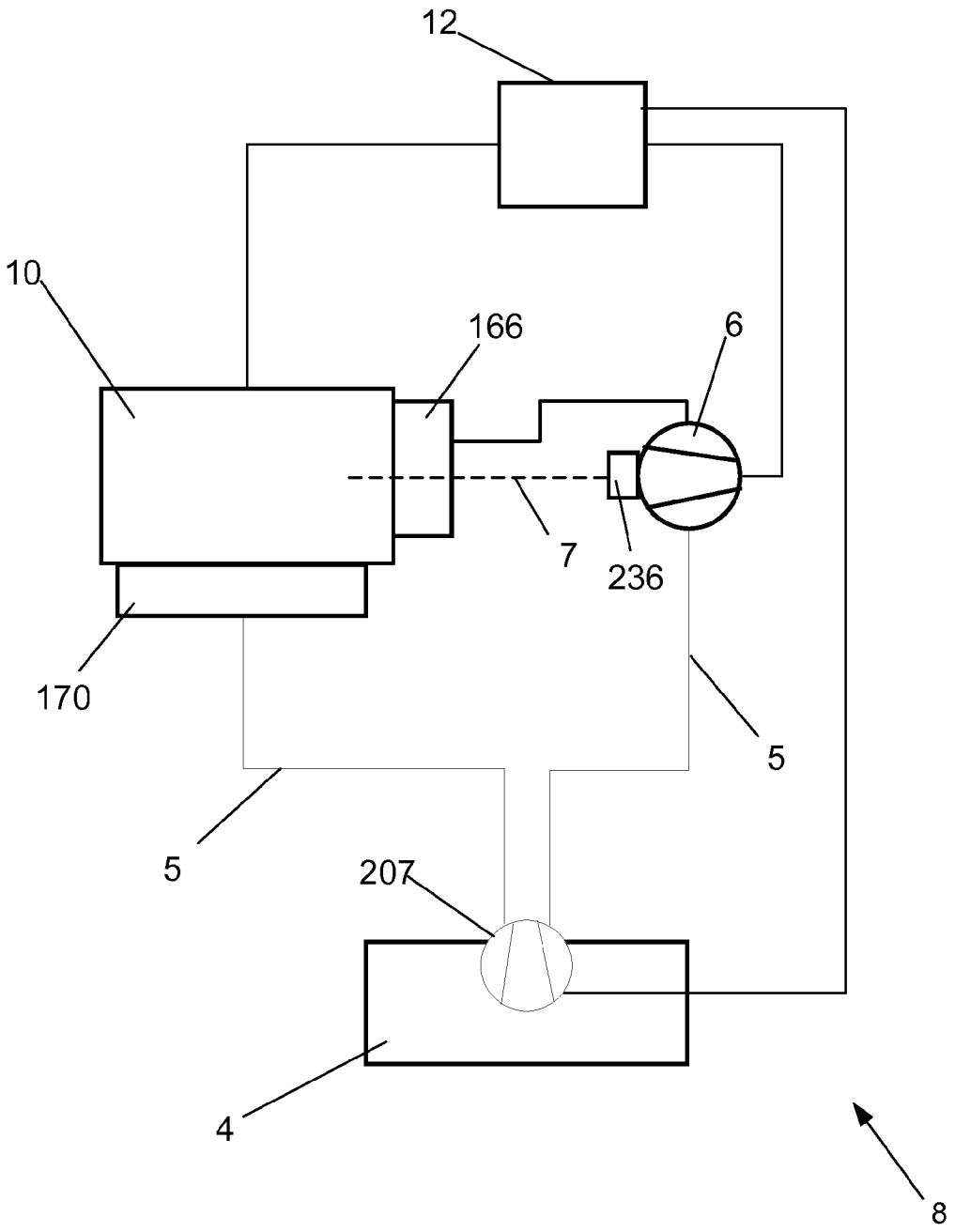
FIG. 2 is a first schematic illustration of an engine having a direct injection system and having a port fuel injection system according to the disclosure.

FIG. 2 shows, in highly schematic form, an internal combustion engine 1 for example for a motor vehicle such as a passenger car or truck. The engine 1 has a direct injection system 2 for injecting fuel into the cylinders and has a port fuel injection system 3 for injecting fuel into the intake tract of the engine 1, for example into the intake manifold. The injection systems 2, 3 may be constituent parts of the engine 1 or may be external units. A tank 4 for the fuel is connected to the injection systems 2, 3 by a pump 8 and via lines 5.

In the line 5 of the direct injection system 2 there is arranged a high-pressure pump 6 for delivering the fuel. The pump 6 is mechanically coupled to the engine 1 or the drive system. The pump 6 may for example be connected directly or indirectly to an engine shaft 7. The pump 6 is generally equipped with an electrically controlled flow-rate control valve (not shown). Said flow-rate control valve can be set by the controller 10 to a zero-delivery position. This has the effect that the fuel is automatically delivered by the pump 8 to the low-pressure side, that is to say, to the port injection system 3. The same applies to direct injection operation. If the port injection system 3 is not actuated, the fuel is automatically delivered to the high-pressure injection system 2.

A controller or regulator 10 actuates the pump 6 of the direct injection system 2 such that the pump 6 can be activated and deactivated as a function of the activation of the direct injection system 2. For this purpose, the controller 10 may actuate the pump 6 directly or actuate an activation mechanism 236, for example in the form of a cam drive or the like.

An engine controller 10 is connected to the engine 1 and to sensors (not illustrated) of the engine 1, of the exhaust system and of further systems. The engine controller 10 normally decides which injection system is used.

The pump and the port fuel injection system or a pump of the port fuel injection system may be connected to a common tank for the fuel. Despite the deactivation capability of the pump, it is possible to realize a simple fuel system.

According to a second aspect of the disclosure, in a method for operating an internal combustion engine having a direct injection system and having a port fuel injection system, a pump for the direct injection system is operated as a function of the operating state of the direct injection system. The same advantages and modifications as those described above apply.

The pump may be deactivated when the direct injection system is or has been deactivated. The pump thus remains in an optimum operating or temperature window at all times. A controller such as the engine controller or an independent controller which is preferably connected to the engine controller may activate the pump already before the activation of the direct injection system, for example already at the time of the demand, in order thereby to build up a fuel supply quickly. If the direct injection system is required or activated again, the pump is activated again in order to supply fuel to the direct injection system.

Below, a method for operating the internal combustion engine 1 having the direct injection system 2 and having the port fuel injection system 3 will be described on the basis of FIG. 6.

Figure 3:
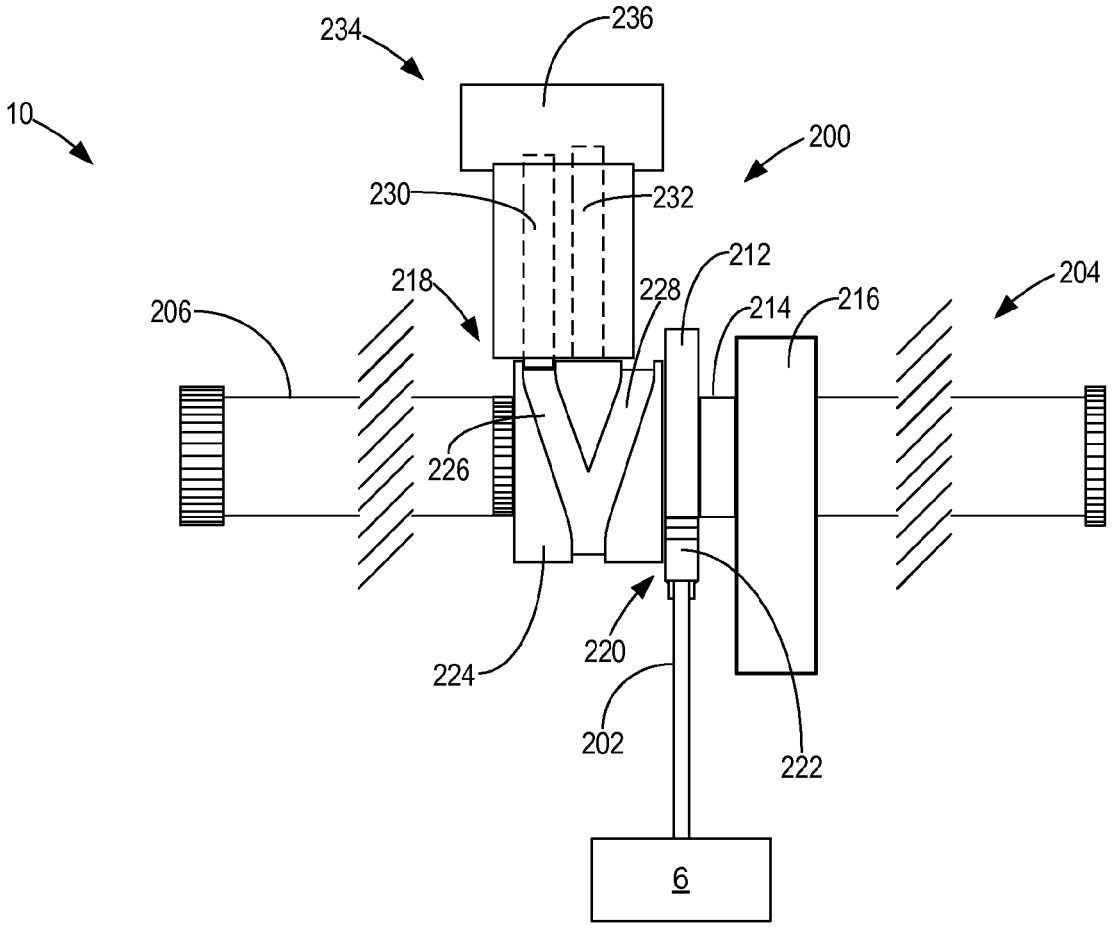
FIG. 3 shows an example cam lobe switching system in accordance with the disclosure.

FIG. 3 shows an example lost motion mechanism 200 in an engine 10 configured to engage a pump actuator 202 in response to engine operating conditions. Engine 10 includes a valve train 204 including a cam shaft 206. Pump actuator 202 power pump 6 which provides fuel to direct injector 166 shown in FIG. 1. The lost motion mechanism 200 allows pump actuator 202 to engage and disengage from being powered by cam shaft 206. It should be appreciated this is one example of a lost motion mechanism and other embodiments may employ different configurations of such a mechanism. One such example is a spring type lost motion mechanism in which a cylindrical rod is inserted into a jacket. Up and down motion resulting from a cam lobe may either engage and the jacket and rod move in concert and motion is thus transferred to an actuator. Alternatively the rod and jacket may be disengaged so that the up and down motion of the cylindrical rod merely moves up and down within the jacket. Furthermore, the pump actuator of the present disclosure may be powered by an overhead cam shaft, crank shaft or other suitable rotary power source.

One or more cam towers or cam shaft mounting regions may support cam shaft 206. For example, cam tower 216 is shown adjacent to pump actuator 202. The cam towers may support overhead camshafts and may separate the lift mechanisms positioned on the camshafts above each cylinder.

Camshaft 206, which may be an intake camshaft or an exhaust camshaft, and may include a plurality of cams configured to control the opening and closing of valves. For example, FIG. 3 shows a first cam lobe 212 and a second cam lobe 214 positioned above pump actuator 202. The cams lobes may include a cam lob 212 configured to engage the pump actuator 202 and another cam lobe 214 with a cylindrical shape (e.g. configured as a zero lift cam) that does not engage the pump actuator 202 while the cam shaft rotates. For example, cam 212 may be a full lift cam lobe and cam 214 may be a zero lift cam lobe. In another embodiment, the pump may be driving by a crankshaft (such as crankshaft 140 in FIG. 1).

Pump actuator 202 includes a mechanism 218 coupled to the camshaft for activating or deactivating pump actuator 202. For example, the cam lobes 212 and 214 may be slideably attached to the cam shaft so that they can slide along the camshaft on a per-cylinder basis. For example, cam lobes 212 and 214, positioned above pump actuator 202, may be slid across the camshaft to activate or deactivate pump actuator 202. The valve cam follower 220 may include a roller finger follower (RFF) 222 which engages with a cam lobe positioned above pump actuator 202. For example, in FIG. 3, roller 222 is shown engaging with full lift cam lobe 212.

An outer sleeve 224 may be coupled to the cam lobes 212 and 214 splined to camshaft 206. By engaging a pin, e.g., one of the pins 230 or 232, into a grooved hub in the outer sleeve, the axial position of the sleeve can be repositioned to that a different cam lobe engages the cam follower coupled to pump actuator 202 in order to change the lift of the valve. For example, sleeve 224 may include one or more displacing grooves, e.g., grooves 226 and 228, which extend around an outer circumference of the sleeve. The displacing grooves may have a helical configuration around the outer sleeve and, in some examples, may form a Y-shaped or V-shaped groove in the outer sleeve, where the Y-shaped or V-shaped groove is configured to engage two different actuator pins, e.g., first pin 230 and second pin 232, at different times in order to move the outer sleeve to change a lift profile for pump actuator 202. Further, a depth of each groove in sleeve 224 may decrease along a length of the groove so that after a pin is deployed into the groove from a home position, the pin is returned to the home position by the decreasing depth of the groove as the sleeve and camshaft rotate.

For example, as shown in FIG. 3, when first pin 230 is deployed into groove 226, outer sleeve 224 will shift in a direction away from cam tower 216 while cam shaft 206 rotates thus positioning cam lobe 214 above pump actuator 202 activating the pump. In order to switch back to cam lobe 212, second pin 232 may be deployed into groove 228 which will shift outer sleeve 224 toward cam tower 216 to position cam lobe 212 above pump actuator 202.

Actuator pins 230 and 232 are included in a cam lobe switching actuator 234 which is configured to adjust the positions of the pins in order to switch cam lobes positioned above a valve. Cam lobe switching actuator 234 includes an activation mechanism 236, which may be hydraulically powered, or electrically actuated, or combinations thereof. Activation mechanism 236 is configured to change positions of the pins in order to activate or deactivate the pump 6 (shown in FIG. 2). For example, activation mechanism 236 may be a coil coupled to both pins 230 and 232 so that when the coil is energized, e.g., via a current supplied thereto from the control system, a force is applied to both pins to deploy both pins toward the sleeve. Example cam lobe switching actuators are described in more detail below with regard to FIGS. 4 and 5.

As remarked above, in approaches which activate both pins at the same time, e.g., by using a single coil actuator coupled to both pins, a timing window may exist where the actuator can be energized until the intended pin deploys in its groove, then the actuator may be de-energized before the other pin falls into the unintended groove which it passes over as the sleeve moves. If the actuator is not de-energized in time, the second pin could fall in the groove causing a mechanical interference. Further, having individual control of the pins typically requires two coils per actuator as well as twice as many control signals from the engine control module, thus increasing costs associated with such systems. Thus, as shown in FIGS. 3-6, a cam lobe switching actuator 234 may include a ball locking mechanism 336 positioned between pins 230 and 232 in a body 314 of the actuator. As described in more detail below, the ball locking mechanism 336 may prevent one pin from deploying after the other (intended) pin has deployed.

Figure 4:
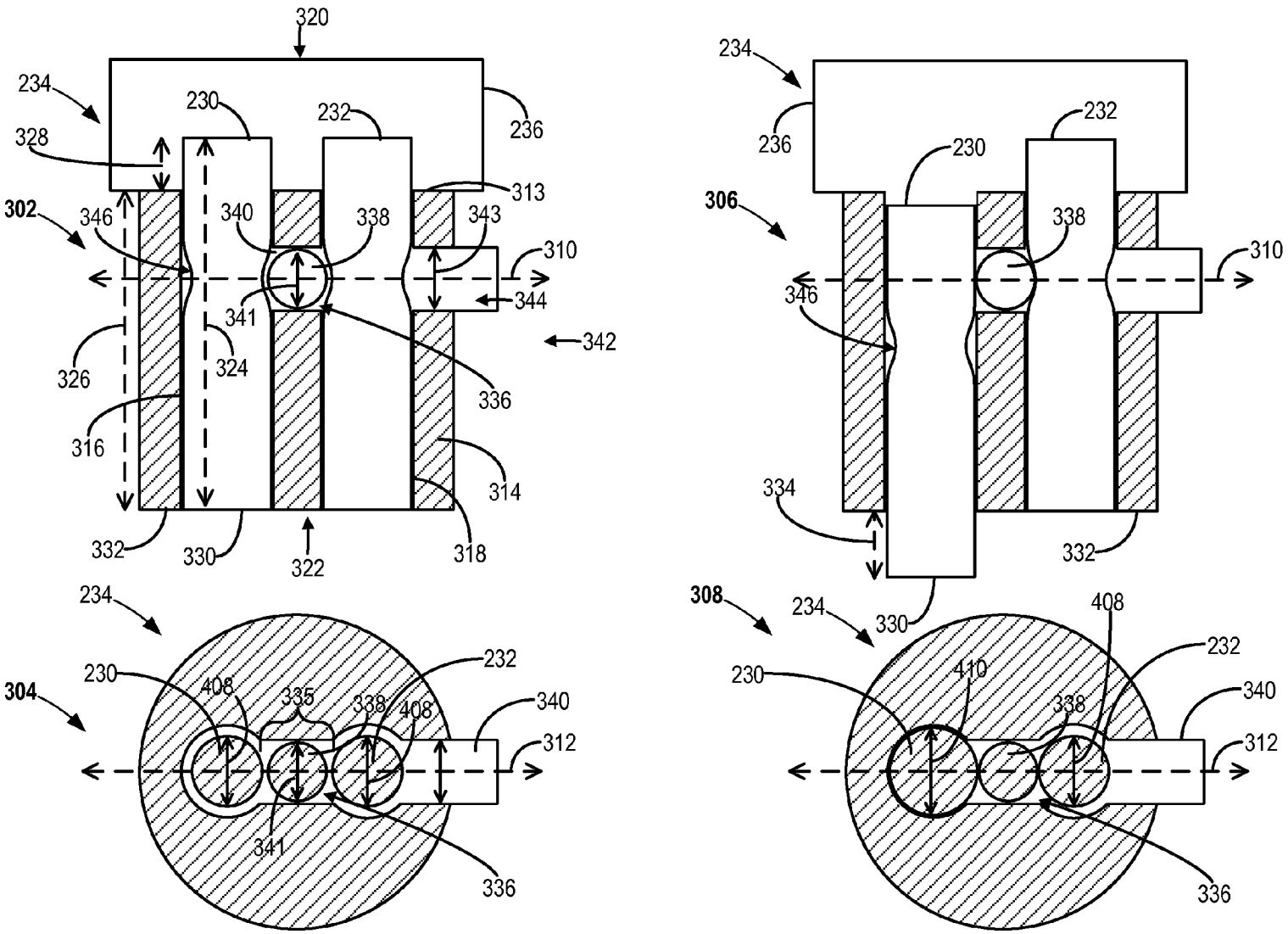
FIG. 4 shows an example cam lobe switching actuator in accordance with the disclosure.

FIG. 4 shows a first example cam lobe switching actuator 234 with a ball locking mechanism 336 from different viewpoints and during different example operational modes. For example, at 302, FIG. 4 shows cam lobe switching actuator 234 from a side view when both pins 230 and 232 are in a home position and at 304, FIG. 4 shows a cross section of actuator 234 along line 310 when both pins are in the home position. The view shown at 302 is a cross-sectional view of the actuator along the center line 312 shown at 304.

At 306, FIG. 4 shows cam lobe switching actuator 234 from a side view when pin 230 is deployed and pin 232 is maintained in the home position and at 308, FIG. 4 shows a cross section of actuator 234 along line 310 when pin 230 is deployed and pin 232 is maintained in the home position. The view shown at 306 is a cross-sectional view of the actuator along the center line 312 shown at 308.

Cam lobe switching actuator 234 includes an activating mechanism 236, which may be hydraulically powered, or electrically actuated, or combinations thereof. In one example, activating mechanism 236 may be a single activating mechanism coupled to both pins 230 and 232 in actuator 234. In response to a signal received from a controller, e.g., controller 12, activating mechanism 236 may be configured to supply a force to both pins 230 and 232 to push the pins away from the activating mechanism 236 towards a grooved sleeve, e.g., sleeve 224 shown in FIG. 3. In response to a second signal received from the controller, activating mechanism 236 may be configured to discontinue applying the force to both pins.

For example, activating mechanism 236 may comprise an electromagnetic coil positioned above both pins 230 and 232. The coil may be configured to be selectively energized, e.g., via a current supplied to the coil, and selectively de-energized, e.g., via removing the current supplied to the coil. In this way, during an energized state of the coil, a force, e.g., an electromagnetic force, may be supplied to both pins 230 and 232 to push the pins towards the sleeve and during a de-energized state of the coil, the force supplied to both pins may be removed so that the pins are moveable within the bores 316 and 318 in an unbiased manner. Generally, some type of magnetic or mechanical mechanism will be employed to hold the pins in the home position when the coil is de-energized. Without this, there would be nothing to prevent a pin falling into a groove when de-energized. This mechanism will not move a fully extended pin back to the home (retracted) position, but will keep a refracted pin from extending.

Cam lobe switching actuator 234 includes a body 314 with a first bore 316 and a second bore 318 extending vertically from a top side 320 of body 314 to a bottom side 322 of body 314. For example, body 314 may be a substantially solid metal component with bores 316 and 318 extending therethrough to create orifices in the body so that first pin 230 is contained or housed within first bore 316 and second pin 232 is contained or housed within second bore 318. In some examples, the bores and pins may be significantly longer in length than their diameter. The pins may be moveable within their respective bores in a vertical direction from top side 320 of body 314 to bottom side 322 of body 314. As remarked above, during certain conditions, movement of the pins within the bores may be biased by a force applied to the pins from the activating mechanism 236.

A height of the pins, e.g., height 324 of first pin 230, may be larger than a height 326 of body 314. Further, the height of each pin in actuator 234 may be substantially the same. As remarked above, each pin may be slideable within the bore which houses it. For example at 302 in FIG. 4, pins 230 and 232 are shown in a home position within actuator 234. In the home position, the pins may extend a positive distance 328 above a top surface 313 of body 314 whereas the bottom surfaces of the pins, e.g., bottom surface 330 of pin 230, may be flush with bottom surface 332 of body 314 so that the pins do not extend beyond the bottom surface of body 314 in the home position.

However, in response to actuating the activating mechanism 236, one or both pins may be moved or deployed to an extended position. For example, as shown at 306 in FIG. 4, pin 230 has been moved away from its home position towards bottom side 322 of body 314 so that bottom surface 330 of pin 230 extends a positive, non-zero distance 334 beyond bottom surface 332 of body 314. During other conditions, the second pin may be deployed in a similar manner to extend beyond the bottom surface of the actuator body 314.

For example, in response to a lift profile change event, actuating mechanism 236 may be energized to apply a force to both pins 230 and 232 in order to bias the pins downward away from the top surface 313 of actuator body 314 toward a grooved outer sleeve, e.g., sleeve 224 shown in FIG. 3, so that pin 230 extends beyond the bottom surface 332 of body 314 to engage a groove, e.g., groove 226, in a sleeve, e.g., sleeve, 224, positioned below the actuator body 314. Upon engagement with the groove, pin 230 may initiate a cam lift profile change by pushing the sleeve into a different position along the cam shaft.

Cam lobe switching actuator 234 includes a ball locking mechanism 336 positioned between bores 316 and 318 in body 314. Ball locking mechanism 336 includes a ball or solid sphere 338 positioned within a hole or orifice 340 between bores 316 and 318. Orifice 340 may extend perpendicularly to the bores towards a side 342 of body 314 and may, in some examples, form an opening 344 in side 342 of body 314. For example, the opening 344 may permit ball 338 to be replaced when the pins are removed from the body 314 during maintenance. However, in other examples, orifice 340 may extend between first bore 316 and second bore 318 and may not extend out the side 342 of body 314.

Ball 338 may be a solid metal ball moveable within orifice 340 between the bores 316 and 318. For example, a diameter 341 of ball 338 may be substantially the same as a diameter 343 of orifice 340 but may be slightly smaller than diameter 343 so that ball 338 is moveable in a horizontal direction along line 310 between the first and second bores in body 314.

Each pin includes an indentation region 346 at a location along the pin adjacent to orifice 344 when the pins are in the home position within body 314. As described in more detail below, an indentation region along a pin may be a curved indentation that extends around the outer circumference of the pin into the solid body of the pin so that ball 338 may engage the indentation in the pin during certain conditions.

Figure 5:
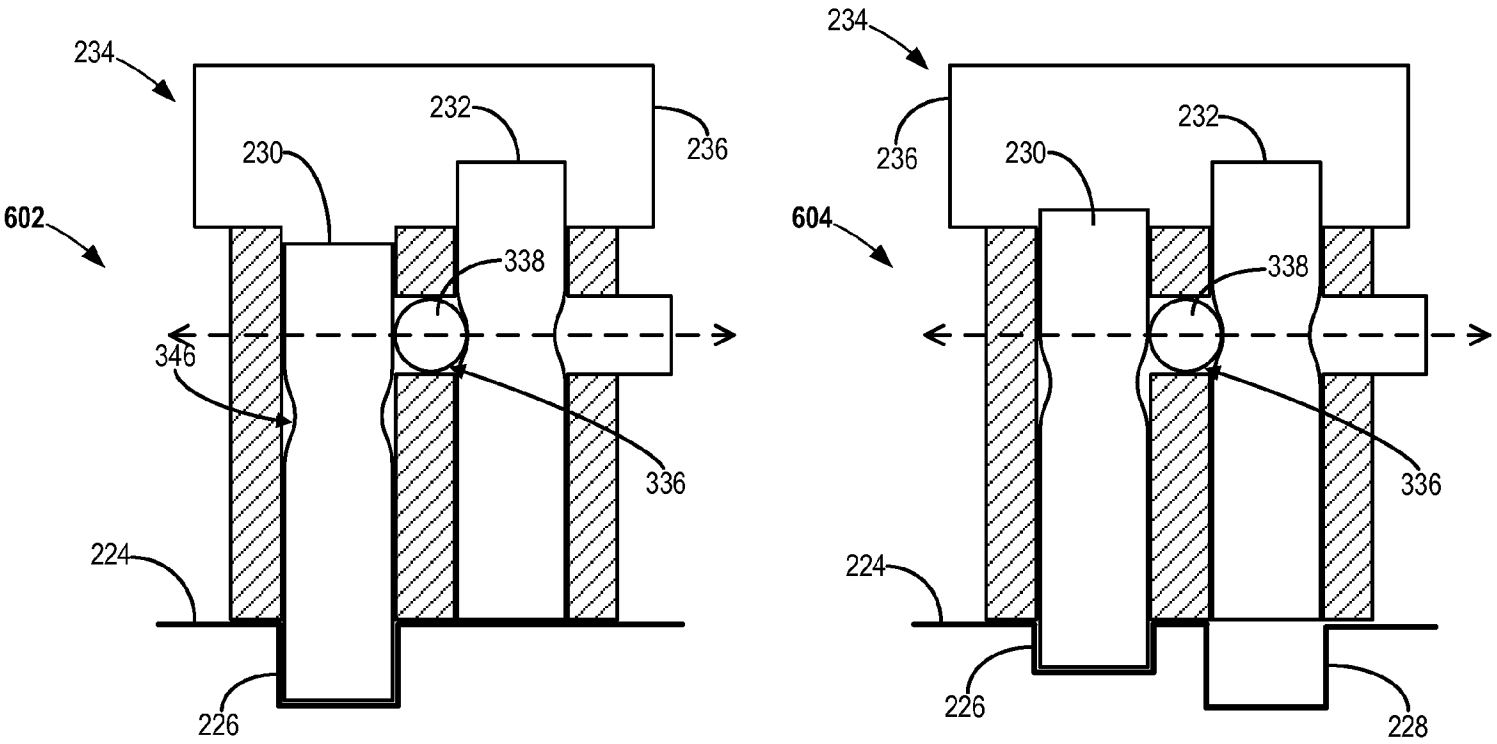
FIG. 5 shows an example cam lobe switching actuator engaging with a sleeve.

FIG. 5 illustrates an example implementation of cam lobe switching actuator 234 during a lift profile switching event. For example, following a lift profile change request, e.g., in response to a change in engine load, speed, or other operating parameter, actuating mechanism 236 may be energized to supply a force to both pins 230 and 232 to push the pins toward outer sleeve 224. As shown at 602, pin 232 is held in the home position by an absence of a groove in the surface of sleeve 224 whereas pin 230 is deployed into a groove 226 in the surface of sleeve 224 below pin 230 so that pin 230 is moved downward into groove 226 in sleeve 224. The downward movement of pin 230 moves the indentation region 346 downward towards sleeve 224 thus causing ball 338 to be pushed into the indentation region of pin 232 to lock pin 232 in place.

As shown at 604, when the first pin 230 is deployed, ball 338 is maintained in a locked position in the indentation of the second pin 232. As the sleeve 224 rotates, a second groove 228 may be present beneath pin 232 while the first pin 230 is deployed in the first groove 226. However, since the second pin 232 is locked into place by the ball 338, the second pin will not deploy into the second groove 228 while the first pin is deployed even while a force is applied to the second pin via the actuating mechanism 236. In some examples, after the first pin 230 has engaged a groove in sleeve 224, the actuating mechanism may be de-energized to remove the force applied to both pins.

As the sleeve 224 continues to rotate, a depth of the first groove may decrease pushing first pin 230 back towards its home position. When the first pin reaches its home position, the indentation in first pin 230 again lines up with ball 338 releasing the ball from a locked position against second pin 232 so that pin 232 may be deployed if desired.

It should be appreciated that FIG. 305 depict a single type of lost motion mechanism. Variations to the mechanism by which pump actuator 202 can be disabled following cylinder disablement do not depart from the present disclosure. Variations to a shape of an outer sleeve are possible as well as variations in cam lobe switching mechanisms. Furthermore, a spring, or telescope type lost motion mechanism is possible wherein, when acting to not propel movement of a cam, an actuator acted on by a cam lobe may move within an outer sleeve without propelling an object on the other end. Additionally, the shaft in question may not be the camshaft as described in reference to FIGS. 3-5. The pump may be run utilizing the movement of the crank shaft in a different embodiment.

Figure 6:
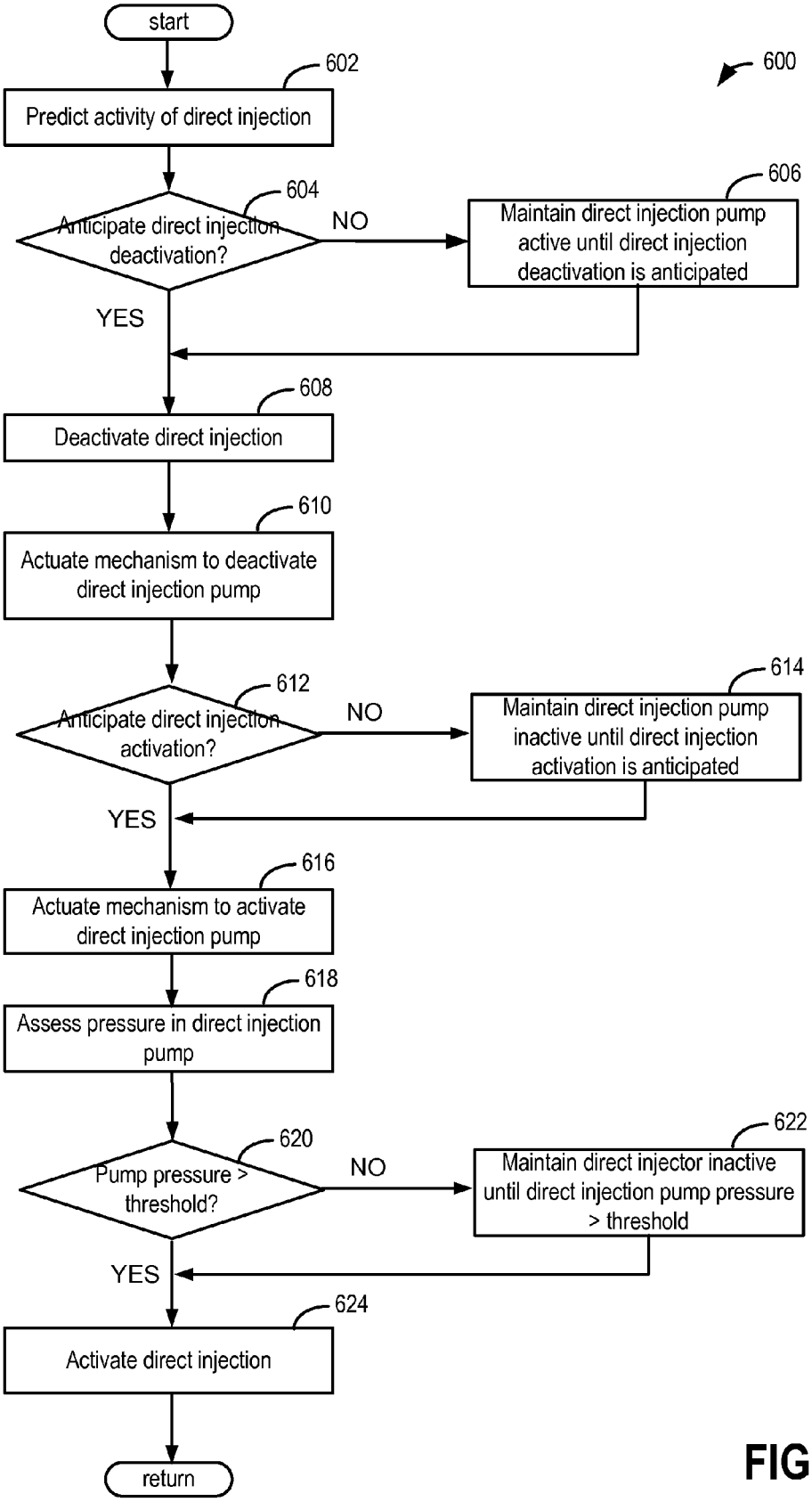
FIG. 6 shows a flow diagram of a method for operating an internal combustion engine according to the disclosure.

Turning now to FIG. 6 a method for operating an engine of the present disclosure is depicted. The method may be controlled in read only memory 110 and carried out by engine controller 12. The method 600 starts with an engine on event. At step 602, the activity of the direct injector is predicted. A prediction may be based on a change in pedal position or a rate of change in pedal position as determined by engine controller 12 from the monitored pedal position sensor 134. Furthermore, a prediction as to the activity of the direct injector may be based on current engine operating parameters such as load, speed, air-fuel ratio, etc. A predictive algorithm may be in continuous operation, such that future activation or deactivation of the direct injector may be anticipated based on monitoring of a pedal position and other engine operating conditions. Once a prediction has been made it is determined at step 604 if it is anticipated that the direct injector will be deactivated. If it is not anticipated (NO) that the direct injector will be deactivated the direct injection pump is maintained active at step 606 until deactivation of the direct injector is anticipated. If deactivation of the direct injector is anticipated at step 604 (YES) the method proceeds to 608.

At step 608, the direct injector is deactivated. It should be appreciated that the port fuel injector is still supplying fuel for combustion when the direct injector is deactivated. At step 610, the mechanism to deactivate the direct injection pump is activated. The activating mechanism 236 is described above with reference to FIG. 3. Actuating the activating mechanism results in a switch of cam lobes a zero lift cam lobe effectively disengaging the direct injection pump from the rotary motion of a cam shaft or crank shaft, deactivating the pump.

The method proceeds to step 612 where it is determined if activation of the direct injector is anticipated. If activation of the direct injector is not anticipated (NO) the direct injection pump is maintained inactive at step 614 until it is anticipated that the direct injector may be activated. If it is anticipated that the direct injector will be activated (YES) the method proceeds to step 616 where the activating mechanism 236 is actuated to switch cam lobes to a lifted lobe such that the pump 6 may be engaged. At step 618 the pressure in the direct injection pump 6 is assessed. Assessment of the pressure within the pump may be determined based on operating conditions of the pump before deactivation and saved within engine controller 12. Furthermore, assessment of the pump pressure may be determined as the pump is activated. At step 620, it is determined if the pump pressure is greater than a threshold pressure. The threshold pressure is the pressure at which a direct injector may effectively be supplied fuel to inject fuel into a combustion chamber. The threshold pressure may be different under different engine operating conditions and may be determined by engine controller 12. If the pressure within the pump is not greater than a threshold pressure (NO) the method proceeds to step 622 where the direct injector is maintained inactive until the pump pressure exceeds the threshold. If the pump pressure is greater than the threshold (YES) the method proceeds to 624. At step 624, the direct injector is activated. In this way, activating the pump occurs prior to activating the direct fuel injection system. The method then returns.

A system and methods are provided to deactivate a cam driven fuel pump. The system comprises a direct fuel injection system; a port fuel injection system; a pump for the direct injection system driven by a cam, wherein the pump can be activated and deactivated as a function of the activation of the direct injection system. Deactivating a pump when no fuel is pumped through it minimizes wear on pump components and increases efficiency.

In one embodiment, a method of operating the engine includes, adjusting an electronically control valve of the high pressure pump to adjust a rail pressure of a rail coupled to a plurality of direct injection injectors of the engine, while the pump is repeatedly driven by a cam. In response to deactivation of the injection of fuel from direct injection injectors, for example while port fuel injection continues, the method may include deactivating the pump for the direct fuel injection system, not by adjusting the electronically controlled valve, or not only by adjusting the electronically controlled valve, but by decoupling rotary motion of the cam powering the pump, for example via a deactivation mechanism on the shaft coupled to the cam. The cam powering the pump may be re-coupled in response to a request for commencing direct fuel injection.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An internal combustion engine comprising:

a direct fuel injection system;

a port fuel injection system;

a pump for the direct fuel injection system driven by a cam lobe; and a controller including non-transitory memory holding instructions to activate and deactivate the pump based on an activation status of the direct fuel injection system and instructions to activate the pump in anticipation of activating the pump based on a rate of change of a pedal position.

2. The engine as claimed in claim 1, wherein the cam lobe driving the pump is arranged on camshaft, and further instructions to activate a direct fuel injector after a pressure in the pump is greater than a threshold pressure.

3. The engine as claimed in claim 1, wherein the cam lobe driving the pump is arranged on an overhead camshaft, and where the anticipation is a prediction based on the rate of change of a pedal position.

4. The engine as claimed in claim 1, wherein the pump is, for deactivation, mechanically disengaged from rotary motion of the cam lobe.

5. The engine as claimed in claim 4, further comprising a lost motion mechanism to mechanically disengage the pump from a drive system.

6. The engine as claimed in claim 1, wherein the pump and the port fuel injection system and a pump of the port fuel injection system are connected to a common tank for fuel.

7. A method comprising:

deactivating a pump for a direct fuel injection system by decoupling rotary motion of a cam powering the pump when the direct fuel injection system is deactivated;

anticipating activation of the direct fuel injection system; and activating the pump when activation of the direct fuel injection system is anticipated, wherein activating the pump occurs prior to activating direct fuel injection, wherein direct fuel injection is activated via a direct fuel injector, and where the anticipation is a prediction based on a rate of change of a pedal position.

8. The method as claimed in claim 7, wherein decoupling rotary motion of the cam is by a lost motion mechanism.

9. The method as claim in claim 7, further comprising supplying fuel by a port fuel injection system during an operating state of the direct fuel injection system.

10. The method as claimed in claim 7, further comprising activating direct fuel injection after a pressure within the pump is greater than a threshold pressure when activation of the direct fuel injection system is anticipated.

11. A system comprising:

a direct fuel injection system;

a pump coupled the direct fuel injection system;

a port fuel injection system;

a rotary shaft powering the pump via a cam drive;

a lost motion mechanism coupled to the rotary shaft to disengage motion of the rotary shaft from the pump; and a controller including instructions stored in non-transitory memory for anticipating a deactivation of direct fuel injectors in the direct fuel injection system, where the anticipation is a prediction based on a rate of change of a pedal position, then deactivating the direct fuel injectors, and disengaging motion of the rotary shaft from the pump after deactivating the direct fuel injectors.

12. The system as claimed in claim 11, wherein the rotary shaft is an overhead camshaft.

13. The system as claimed in claim 11, further comprising instructions for adjusting operation of the lost motion mechanism responsive to engine operating conditions.

14. The system as claimed in claim 11, further comprising instructions for actuating the lost motion mechanism to engage motion of the rotary shaft to the pump before activating the direct fuel injectors in the direct fuel injection system.

15. The system as claimed in claim 11, further comprising instructions for actuating the direct fuel injectors in the direct fuel injection system after a pressure in the pump is greater than a threshold pressure.

* * * * *